US008839853B1

(12) United States Patent
Angers, Jr.

(10) Patent No.: US 8,839,853 B1
(45) Date of Patent: Sep. 23, 2014

(54) MUD BUCKET SYSTEM

(76) Inventor: John W Angers, Jr., Youngsville, LA (US)

( * ) Notice: Subject to any disclaimer, the term of this patent is extended or adjusted under 35 U.S.C. 154(b) by 254 days.

(21) Appl. No.: 12/910,710

(22) Filed: Oct. 22, 2010

Related U.S. Application Data

(60) Provisional application No. 61/254,035, filed on Oct. 22, 2009, provisional application No. 61/309,986, filed on Mar. 3, 2010.

(51) Int. Cl.
*E21B 19/00* (2006.01)

(52) U.S. Cl.
USPC ..... 166/81.1; 175/207; 175/214

(58) Field of Classification Search
USPC ..... 166/81.1; 175/207
See application file for complete search history.

(56) References Cited

U.S. PATENT DOCUMENTS

| | | | | |
|---|---|---|---|---|
| 2,096,882 | A | 10/1937 | Chernosky | |
| 2,214,428 | A | 9/1940 | Miller | |
| 2,522,444 | A | 9/1950 | Grable | |
| 4,450,905 | A | 5/1984 | Crain | |
| 5,295,536 | A | 3/1994 | Bode | |
| 6,158,321 | A * | 12/2000 | Fencil | 83/745 |
| 7,306,032 | B2 | 12/2007 | Paton | |
| 7,509,722 | B2 * | 3/2009 | Shahin et al. | 29/407.09 |
| 2005/0205303 | A1 * | 9/2005 | Pearson | 175/57 |

* cited by examiner

*Primary Examiner* — Jennifer H Gay
*Assistant Examiner* — Caroline Butcher
(74) *Attorney, Agent, or Firm* — Joseph T Regard, Ltd plc

(57) ABSTRACT

A drilling mud collection apparatus for containing a drill pipe connection so as to collect and drain drilling fluid, mud or the like draining from a length of tubing as it is removed from the connection at the well, in a device commonly known as a mud bucket. A preferred embodiment of the present invention utilizes fluid-driven linear actuators positioned to urge the pivot point of engaged enclosure components from an open position, for receiving or releasing the drill pipe connection, to a closed position for enveloping same to facilitate the collection of liquids therefrom.

42 Claims, 13 Drawing Sheets

MUD BUCKET SYSTEM

PRIORITY CLAIM

The present application claims the benefit of U.S. Provisional Patent Application Ser. No. 61/254,035 filed Oct. 22, 2009 entitled "Mud Bucket", and listing as inventor John W. Angers, Jr, the contents of which are incorporated herein by reference thereto.

The present application also claims the benefit of U.S. Provisional Patent Application Ser. No. 61/309,986 filed Mar. 3, 2010, entitled "Mud Bucket", also listing as inventor John W. Angers, Jr, the contents of which are incorporated herein by reference thereto.

FIELD OF THE INVENTION

The present invention relates to well equipment, and in particular to a drilling mud collection apparatus for containing a drill pipe connection so as to collect and drain drilling fluid, mud or the like draining from a length of tubing as it is removed from the connection at the well, in a device commonly known as a mud bucket. Unlike devices of the past, the mud bucket of the present invention is comparatively light weight and fluid actuated, so as to provide an easier, more effective, and safer system to operate.

GENERAL DISCUSSION OF THE INVENTION

The preferred embodiment of the present invention comprises an elongated collection tank, preferably cylindrical and split along its length, the tank having an inner diameter formed to selectively envelope the connected joints or connectors of two lengths of pipe (formed of the end pipe and the next pipe on the string) such that, when the pipe is unscrewed from the next pipe, the fluid in the end pipe is collected by the collection tank, which has a drain to direct, via flexible pipe or the like, the collected fluid to a storage tank or the like.

The collection tank of the mud bucket is longitudinally split into first and second parts, which are pivotally connected at one side so as to be able to be opened and closed similar to a clamshell, the system further incorporating one or more actuators to facilitate operation (opening or closing) on demand. The first and second ends of the tank have first and second end openings, respectively, formed to receive and engage the outer diameter of opposing ends of the connected pipe joints of the drill pipes, with said first and second openings having a seal to provide fluid tight, sealed engagement of said outer diameter of the pipes so as to prevent leakage during the draining operation and with the closed tank forming a fluid tight enclosure about the connected pipe joints. The edges of the two split parts forming the collection tank each have gaskets to engage to form a fluid tight container when closed and enveloping the drill pipe during operation.

A support frame to control operation of the tank is provided having a length engaging the first and second parts forming the collection tank, the frame having three pneumatic actuators laterally communicating with the pivotal connection of the split parts forming the tank so as to simultaneously extend on demand to force the pivoted portion of the split tank in a first direction, opening the tank, and a second, retracted position, pulling the pivoted portion in a second direction, closing the tank. Pinch rollers are also used in the closing operation so as to provide pressure against the opposing outer split tank walls to urge the split portions together and align the seals along the split edges of the tank to provide an enclosure having a fluid tight seal where the split edges forming the tank meet. The support frame further supports the first and second parts of the tank in pivotal and slotted fashion, retaining the device in controlled fashion during operation, while allowing the tank component parts to pivot from open or closed position when the actuators extend or retract on demand, respectively.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
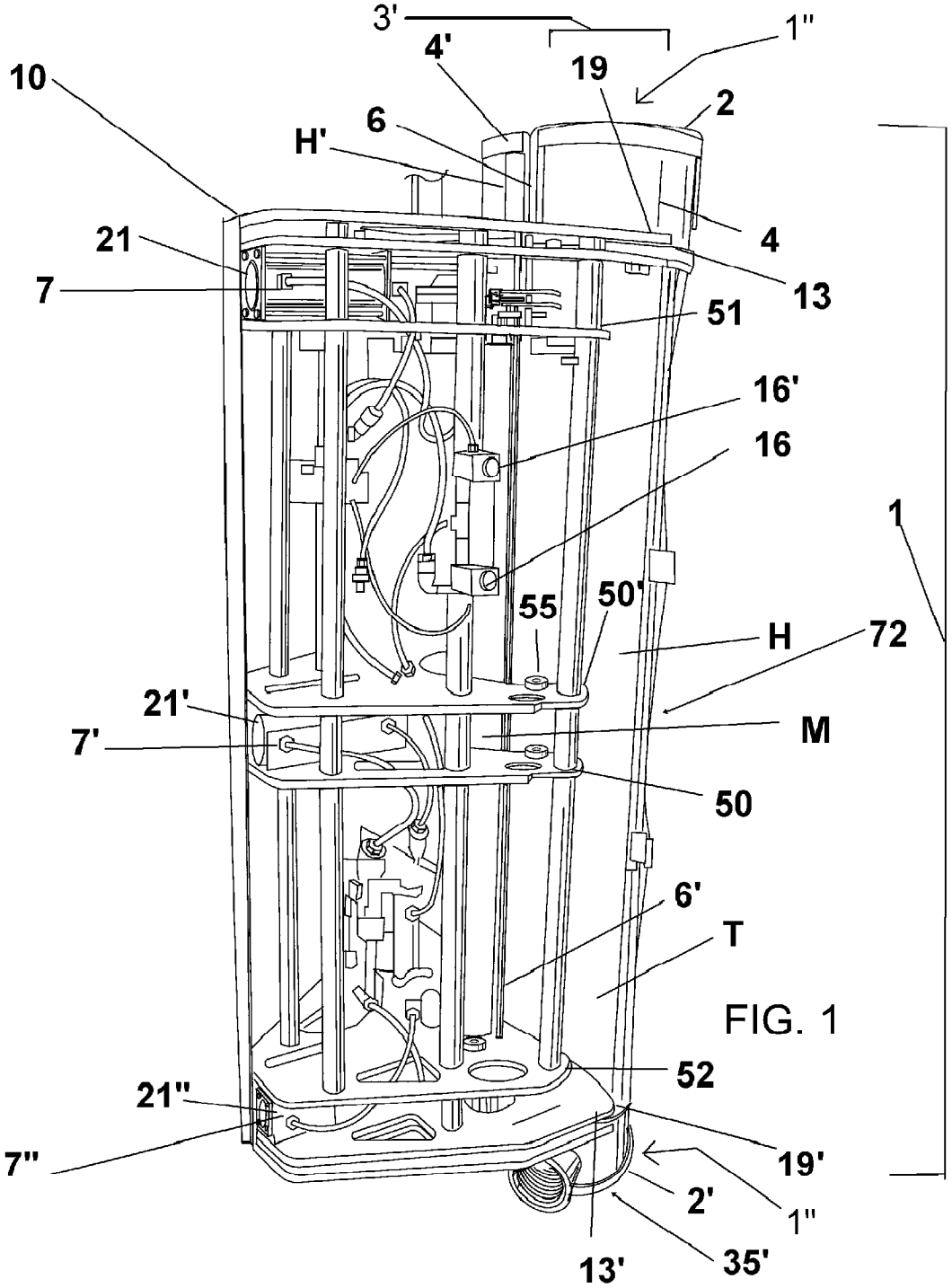
FIG. 1 is a side view of the apparatus of the present invention showing a side cover removed, revealing the three pneumatic actuators and actuator controls.
Figure 2:
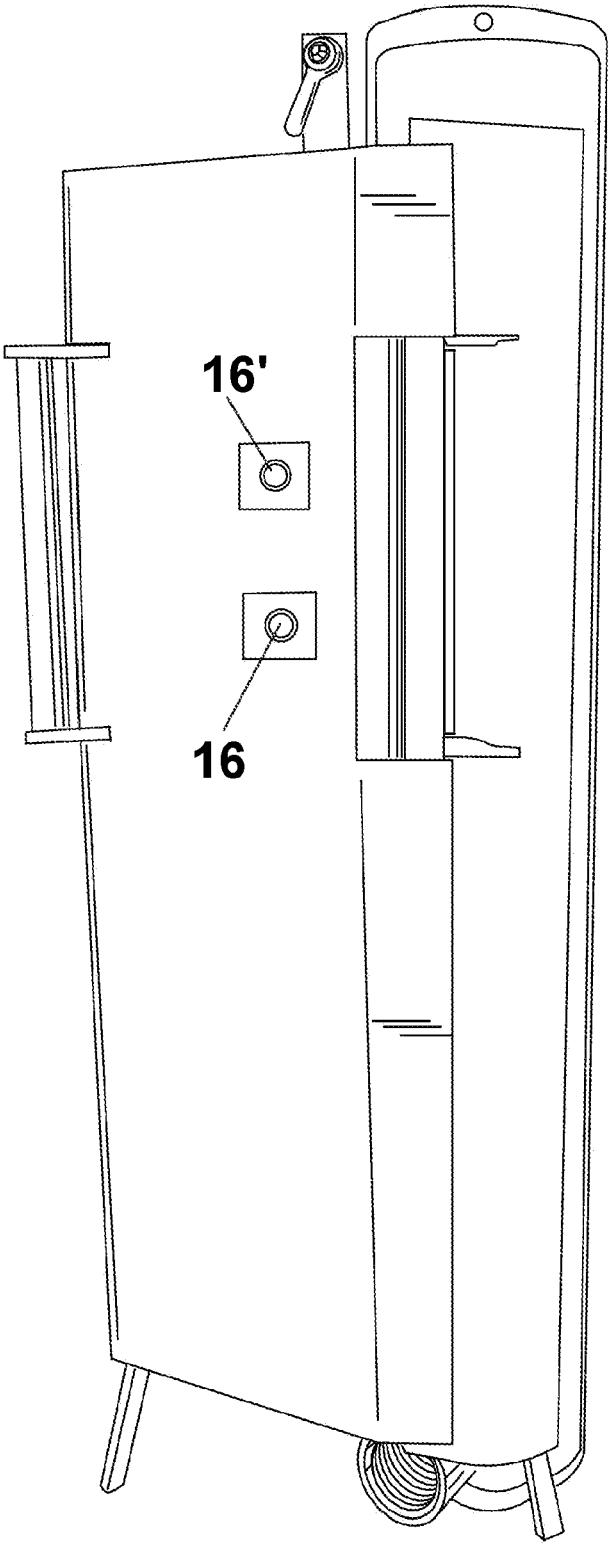
FIG. 2 is a side view of the apparatus of FIG. 1, illustrating the side cover in place, illustrating the actuator control buttons, skirt, and the collection tank shown in a closed position.
Figure 3:
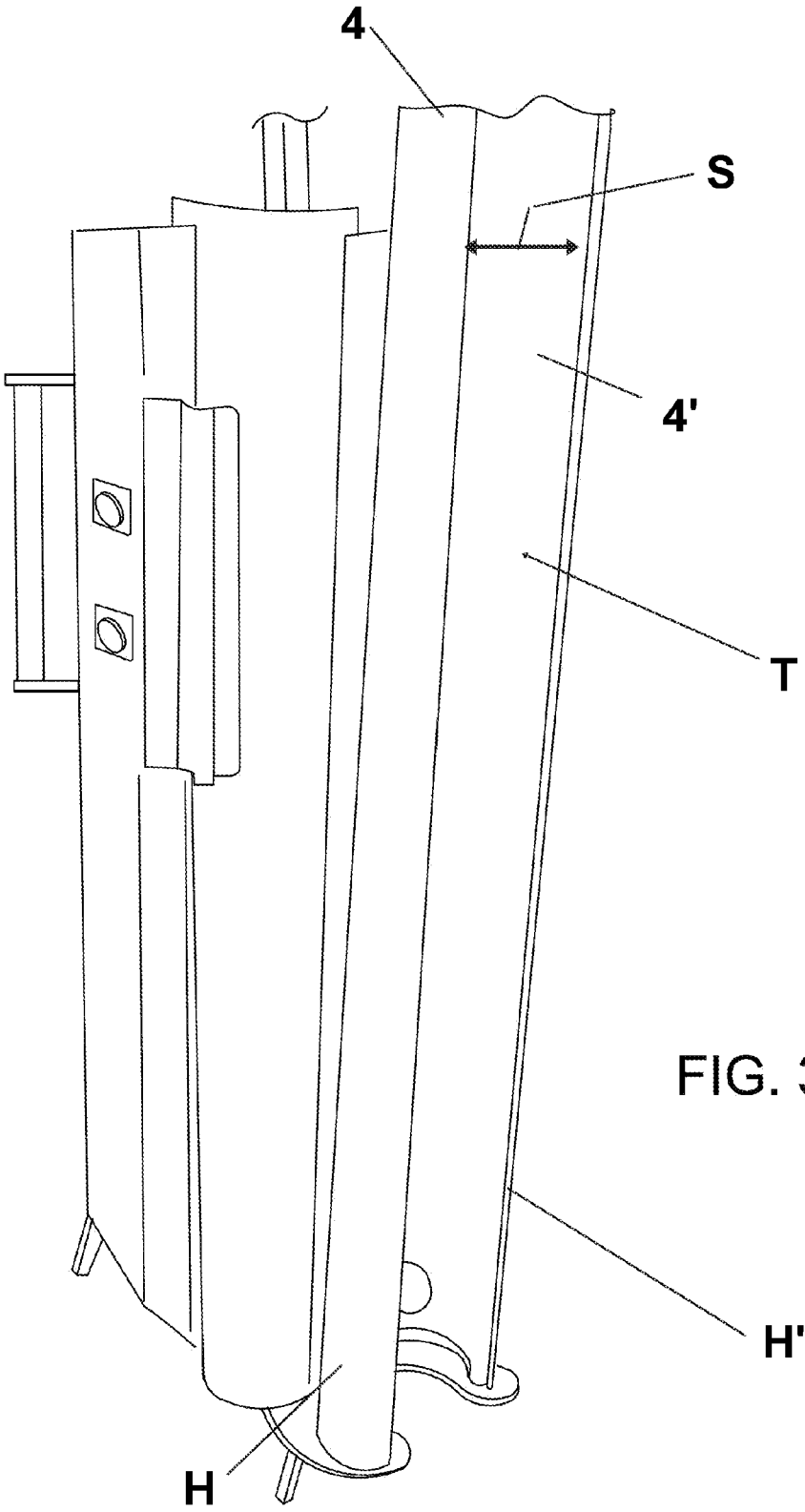
FIG. 3 is a side view of the apparatus of FIG. 2, illustrating the collection tank in an open position.
Figure 4:
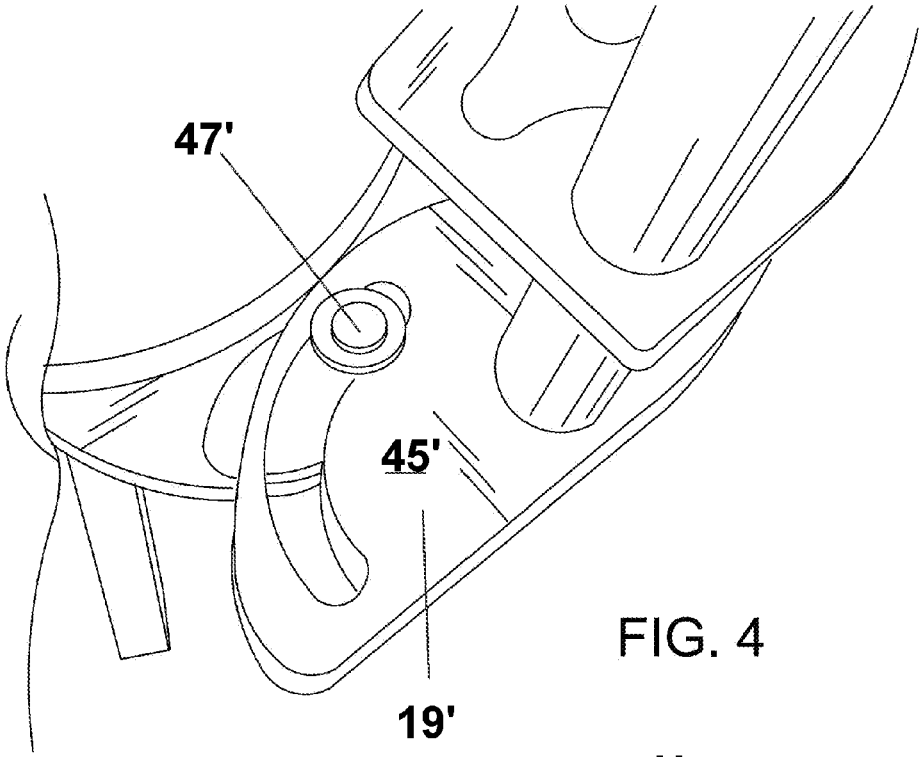
FIG. 4 is a close up of the radial slots in the lower portion of the frame engaging one of the tank halves forming the collection tank.
Figure 5:
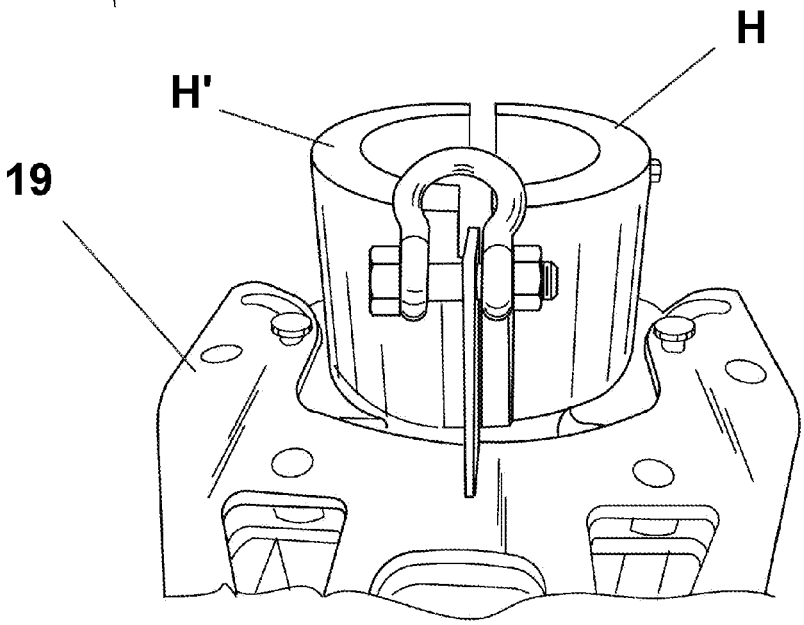
FIG. 5 is a close-up of the top end of the collection tank in a closed position, further illustrating opposing radial slots on the upper portion of the frame engaging the upper portions of the tank halves forming the collection tank.
Figure 6:
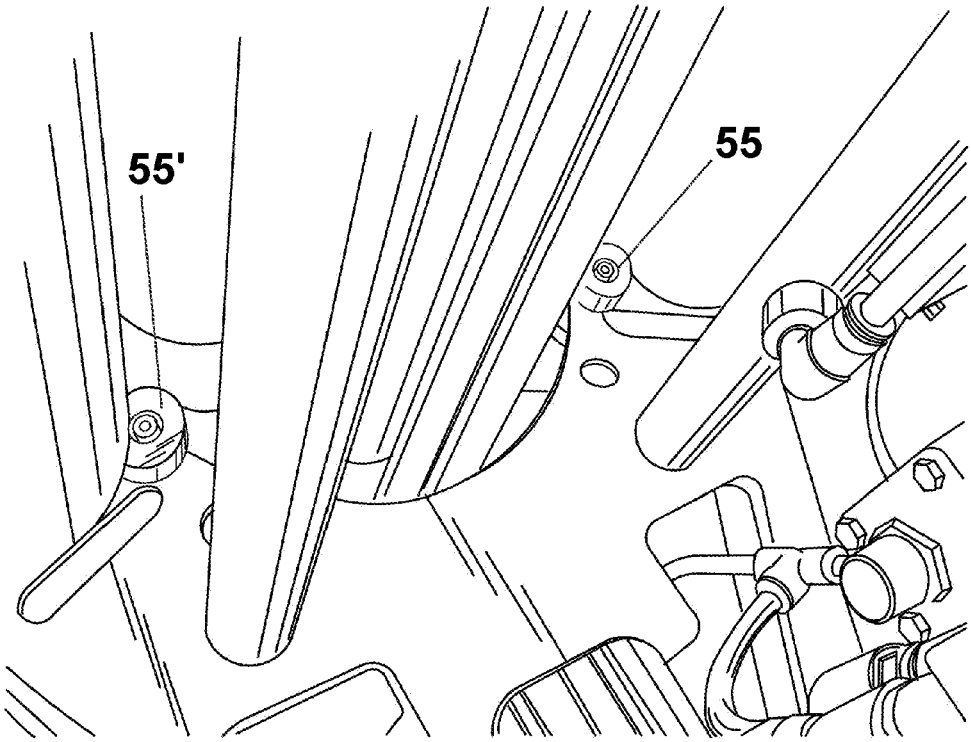
FIG. 6 is a isometric, close-up view of the inner housing showing the tank in a closed position and the opposing pinch rollers engaging same.
Figure 12:
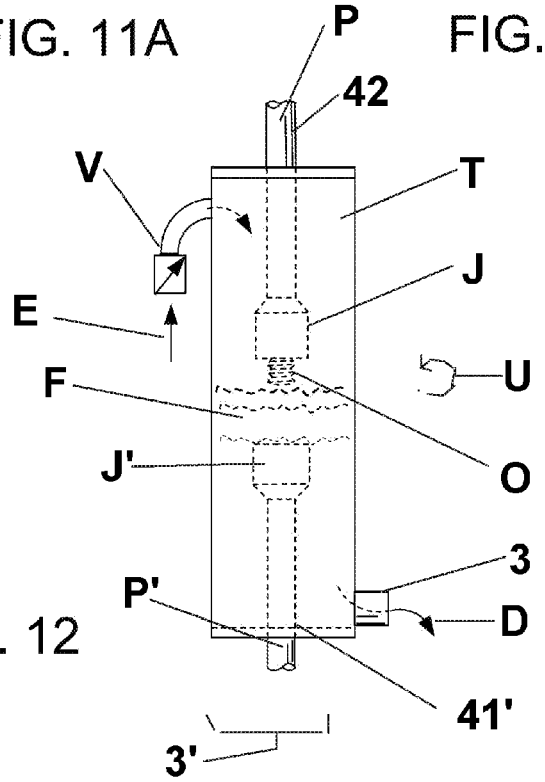
FIG. 12 is a frontal view of the invention of FIG. 1 with the tank shown enveloping first and second pipe joints which are separated, with the upper pipe shown draining its fluid contents into the tank for draining, and an upper air vent allowing the flow of air in to displace the fluid drained from the tank.
Figure 13:
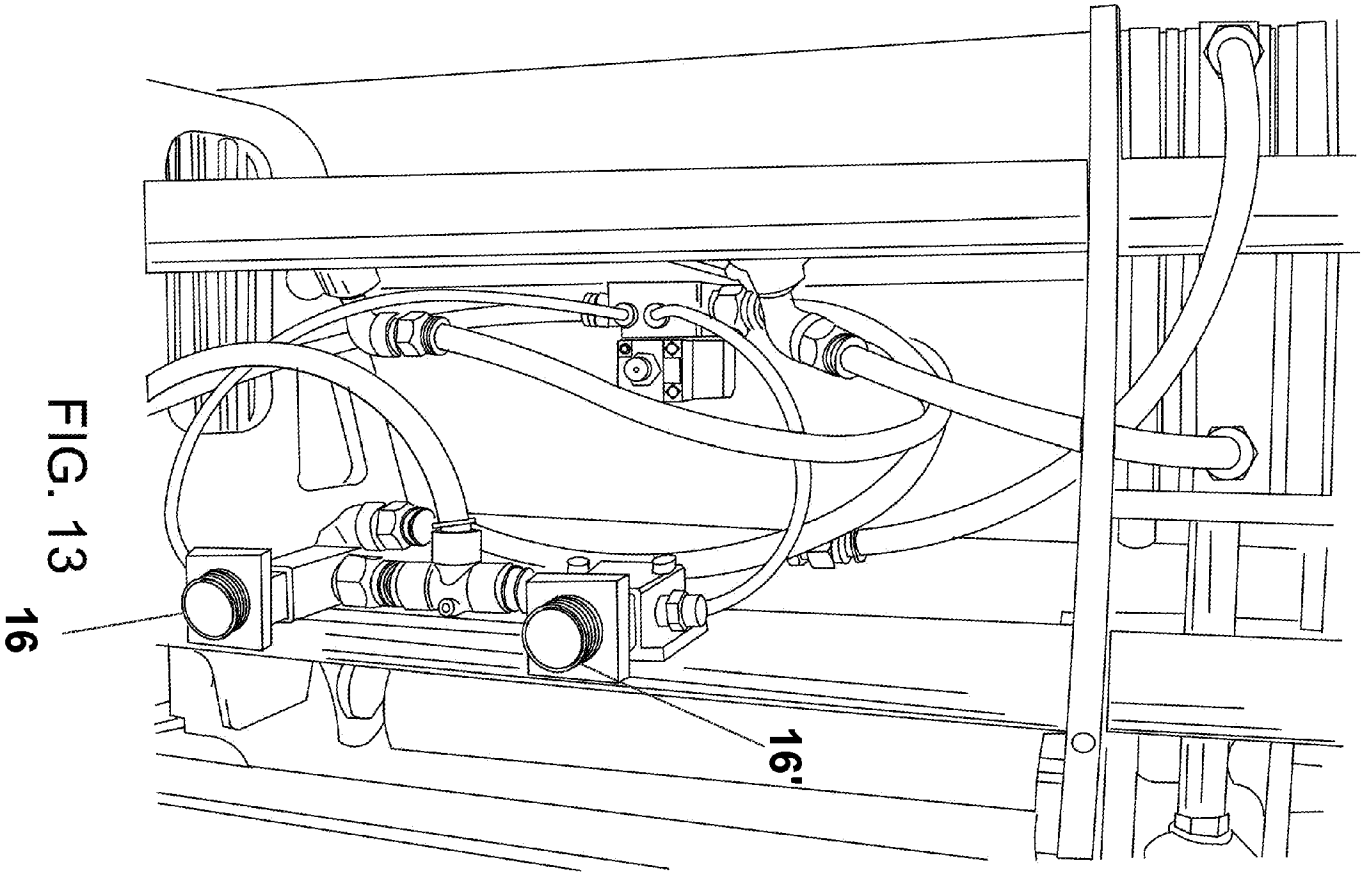
FIG. 13 is a side, close-up view of the pneumatic controls and upper pneumatic actuator of the invention of FIG. 1.
Figure 14:
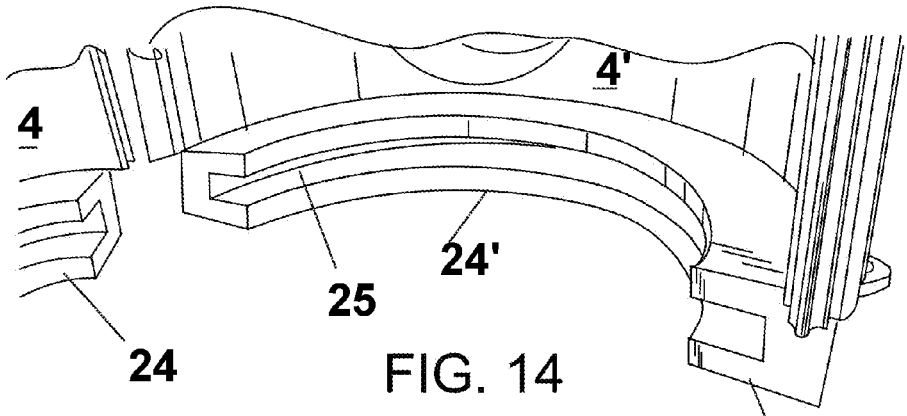
FIG. 14 is an isometric, close-up view of the lower end of the split tank in an open position, showing the first and second grooved mounts for receiving the first and second end seals, respectively.
Figure 15:
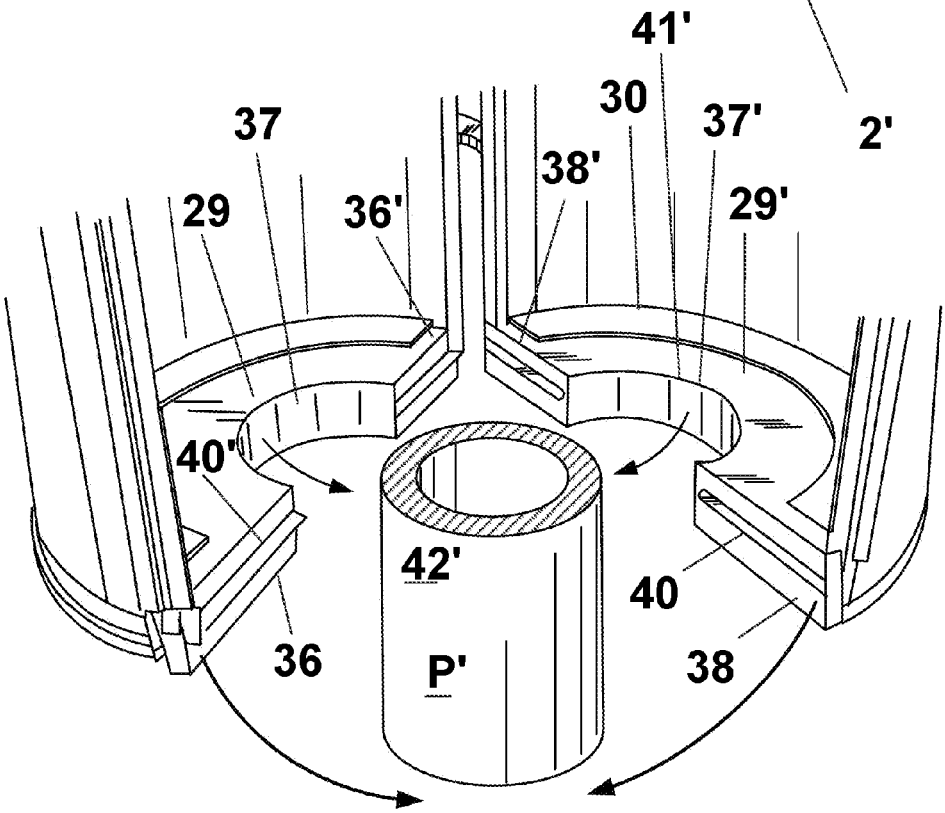
FIG. 15 is an isometric, close up view of the invention of FIG. 14, illustrating the placement of the first and second end seals in the first and second grooved mounts, respectively, and further illustrating the engagement of the first and second seals, upon closing of the split tank, about the outer diameter of a drill pipe.
Figure 16:
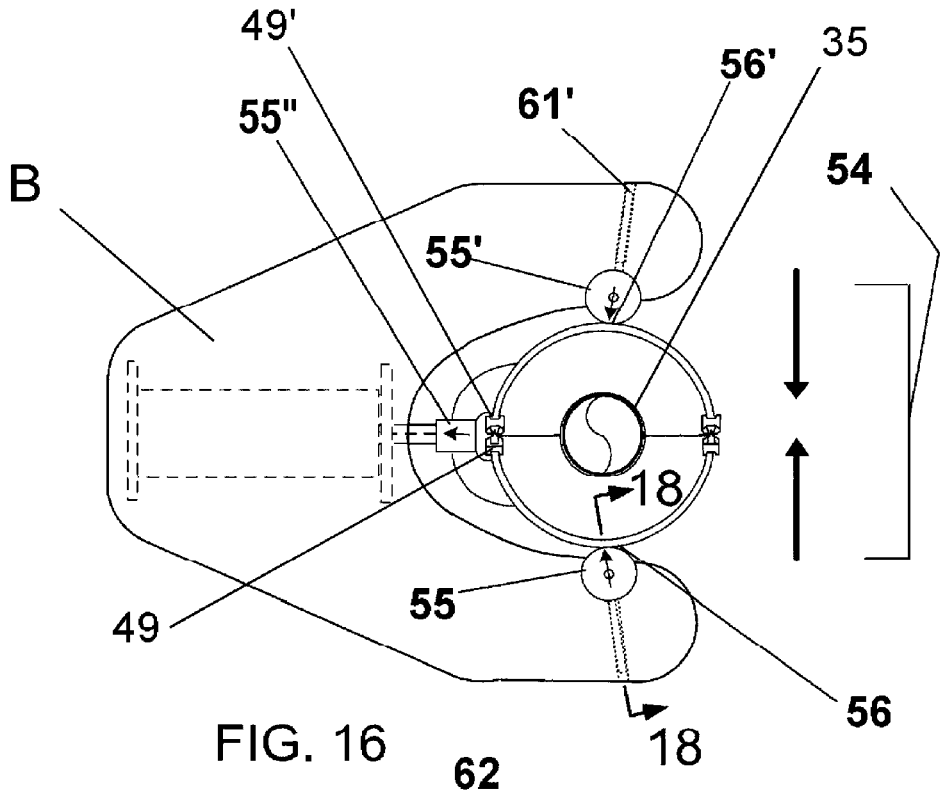
FIG. 16 is a top view of opposing pinch rollers mounted to a yoke support frame for urging the split tank with the underlying pneumatic cylinder actuator in the piston rod retracted position, resulting in the pinch rollers contacting the outer walls of the split tank sections, urging same into a closed and sealed position.
Figure 17:
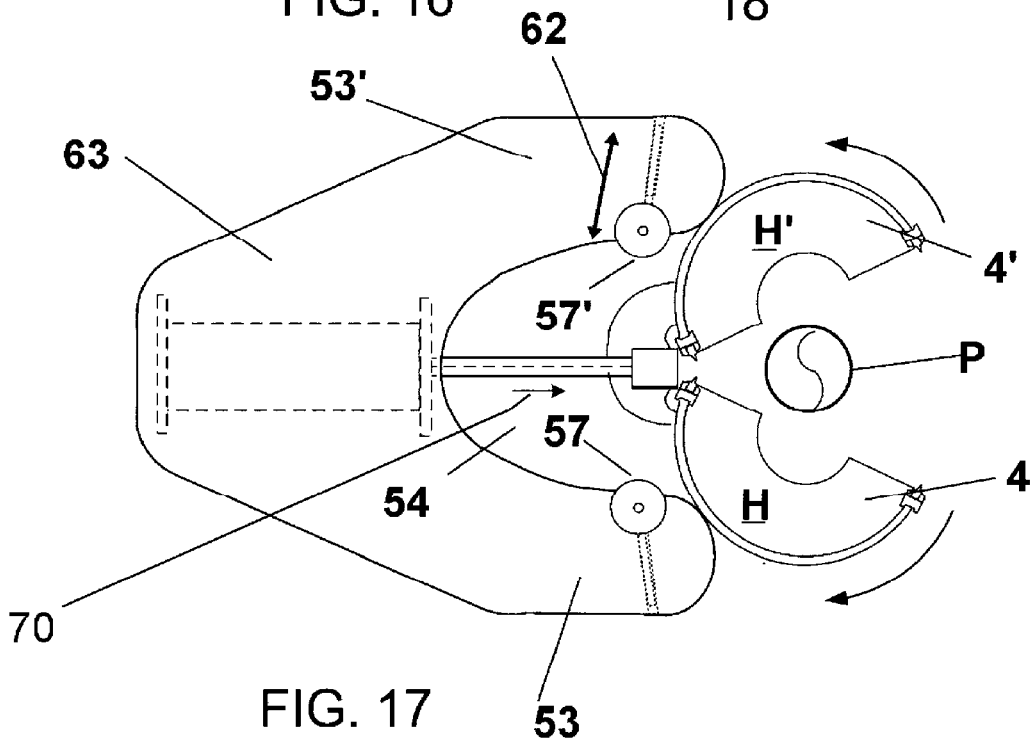
FIG. 17 is a top view of the opposing pinch rollers mounted to a yoke support frame of FIG. 16, with the piston rod in an extended position, allowing the split tank sections to separate into an open position to receive or allow the removal of a pipe situated therebetween.

Referring to the FIGS. 1 and 12, the preferred embodiment of the present invention comprises an elongated collection tank T having a length 1 and first 2 and second 2' ends, the tank being preferably cylindrical, having an inner diameter 3' formed to selectively contain connected joints J, J' of two lengths of pipe (formed of the end pipe P and the next pipe P' on the string) such that, when the end pipe P is unscrewed U from the next pipe P' (with the tank T containing the joints being unscrewed), the fluid F contained in pipe P flows from the opening O into the collection tank, which has a drain 3 to direct, via flexible conduit or the like, the collected fluid, which flows D to a storage tank or the like. Vent V, which may comprise a check valve or simply an tube at the upper portion of the tank T, allows the ingress E of air into the tank T to displace the mud or other fluid F draining therefrom.

Continuing with FIGS. 1, 3, 5, 8, 9A-D, 10B, and 15, and collection tank T of the mud bucket of the present invention is longitudinally split S in half and formed of first 4 and second 4' tank halves H, H', respectively, each of which are joined to at pivot points 5,',"(such as via a clevis assembly 22 engaging the piston rod, as shown) along one side 6, 6' of the length of the of each of the tank halves H, H', so as to allow the first 4 and second 4' tank halves H, H' to be able to be pivotally 11, 11 positioned simultaneously to open 18 and close 18' the tank T in clamshell fashion, the system preferred embodiment of the system utilizing three actuators 7, 7', 7" spaced along the length of the tank halves along the split tank halves pivotal engagement, so as to selective opening 18 or closing 18' of the tank on by extending or retracting said actuators, respectively.

Continuing with FIGS. 1, 8, 8A, 9A-9D, 14, 15, 16 and 17, the first 4 and second 4' split tank halves are pivotally engaged to selectively form collection tank T, which has first 2 and second 2' ends and an inner diameter 3'. At each of the first and second ends 2, 2' (respectively) of the tank there is formed openings 1', 1" respectively. At said ends 2, 2' for each of said first 4 and second 4' split tank halves there is provided upper end seal mounts 23, 23' and lower end seal mounts 24, 24' associated with the first 4 and second 4' split tank halves, respectively, each of the seal mounts having a radial mounting slot 25 formed therein to receive an end seal.

As shown in the Figures, end seals 28, 28', 29, 29' are provided having a radial outer edge 30, each formed to engage a respective radial mounting slot 25 associated with each of the respective seal mounts 23, 23', 24, 24'.

At the upper, first end 2 of the tank, end seal 28 is formed to have first 31 and second 31' faces with an inwardly directed semicircular cut 32 formed therebetween, said first and second faces having a female slot 34 formed therein. Said first 31 and second 31' faces of said end seal 28 are formed for face-to-face engagement with opposing first 33 and second 33' faces formed in opposing end seal 28', said first 33 and second 33' faces having a raised ridge 34' formed to engage female slot 34 so as to provide a fluid impermeable seal therebetween, when the opposing seals 28, 28' are engaged in face-to-face engagement. Like end seal 28, opposing end seal 28' has an inwardly directed semicircular cut 32' situated between said first 33 and second 33' faces.

When the opposing seals 28, 28' are joined in face-to-face contact, said semi-circular cuts 32, 32' are joined to form a circular pipe passage 35 having inner diameter 41, which may be sized to engage the outer diameter 42 of a pipe P passing therethrough to provide a fluid tight seal therebetween.

Likewise, at the lower, second end 2' of the tank, end seal 29 is formed to have first 36 and second 36' faces with an inwardly directed semicircular cut 37 therebetween, said first and second faces having a raised ridge 40' formed thereon. Said first 36 and second 36' faces of said end seal 29 are formed for face-to-face engagement with opposing first 38 and second 38' face formed in opposing end seal 29', said first 38 and second 38' faces having a female slot 40 formed therein to engage raised ridge 40' so as to provide a fluid impermeable seal therebetween when the opposing seals 29, 29' are engaged in face-to-face engagement. Like end seal 29, opposing end seal 29' has an inwardly directed semicircular cut 37' situated between said first 38 and second 38' faces.

When the first 4 and second 4' tank halves H, H' are closed 18' and the opposing seals 29, 29' are joined in face-to-face contact, said semi-circular cuts 37, 37' are joined to form a circular pipe P' passage 35' having inner diameter 41', which may be sized to engage the outer diameter 42' of pipe P' so as to provide a fluid-tight seal when passing therethrough.

In addition to the seals at the first 2 and second 2' ends of the tank, there is provided seals along the full lengths of the inner 6, 6' and outer 8, 8' edges of the first 4 and second 4' tank halves H, H' (which run the length 1 of the tank T) for secure containment of any fluids within the tank enclosure.

More particularly, first 4 tank half H has situated along its respective inner side edge 6 a first seal strip 9 having, for example, a female profile 43' (FIG. 8A), formed to engage a second seal strip 9' situated along inner side edge 6' of second 4' tank half H' having a male profile 43 (FIG. 8B), or visa versa.

Similarly, first 4 tank half H has situated along its respective outer seal edge 8 a first seal strip 27 having, for example, a male profile 43 (FIG. 8B), formed to engage a second seal strip 27' situated along the outer side edge 8' of second 4' tank half H' having a female profile 43' (FIG. 8A), or visa versa.

The seal strips 9, 9', and 27, 27' are formed to engage when the first 4 and second 4' tank halves H, H' of respective edges 6, 6' and 7, 7' are brought together so as to form a fluid tight connection therebetween, respectively. The male has a bulbous tip to secure in the female due to compensate for possible partial separation of the tank halves due to pressure variations due to fluid dumped therein, so as to provide a redundant, self sealing feature.

Continuing with FIGS. 1-4 and 9A-9D, a support frame 10 is provided having a length 1 supporting the first 4 and second 4' tank halves H, H' forming the collection tank T, the frame 10 housing and positioning the three pneumatic cylinder actuators 7, 7', 7" laterally communicating with the first 4 and second 4' tank halves near their respective inner side edges 6, 6', at the first 2, medial M and second 2' areas of the tank T, respectively.

Figure 7:
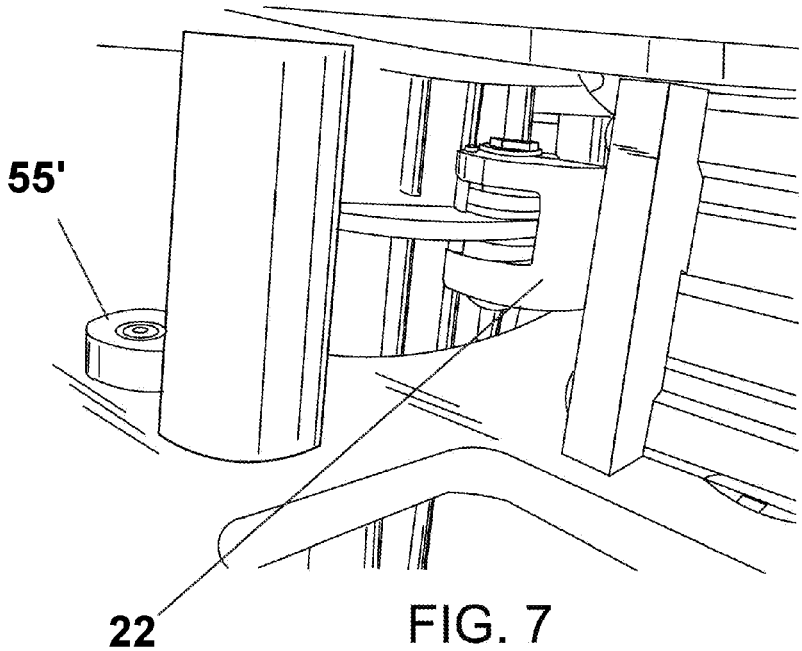
FIG. 7 is a side isometric, close-up view illustrating the clevis assembly from the pivot rod of a pneumatic piston actuator forming the pivotal connection of the two tank halves forming the collection tank.
Figure 8:
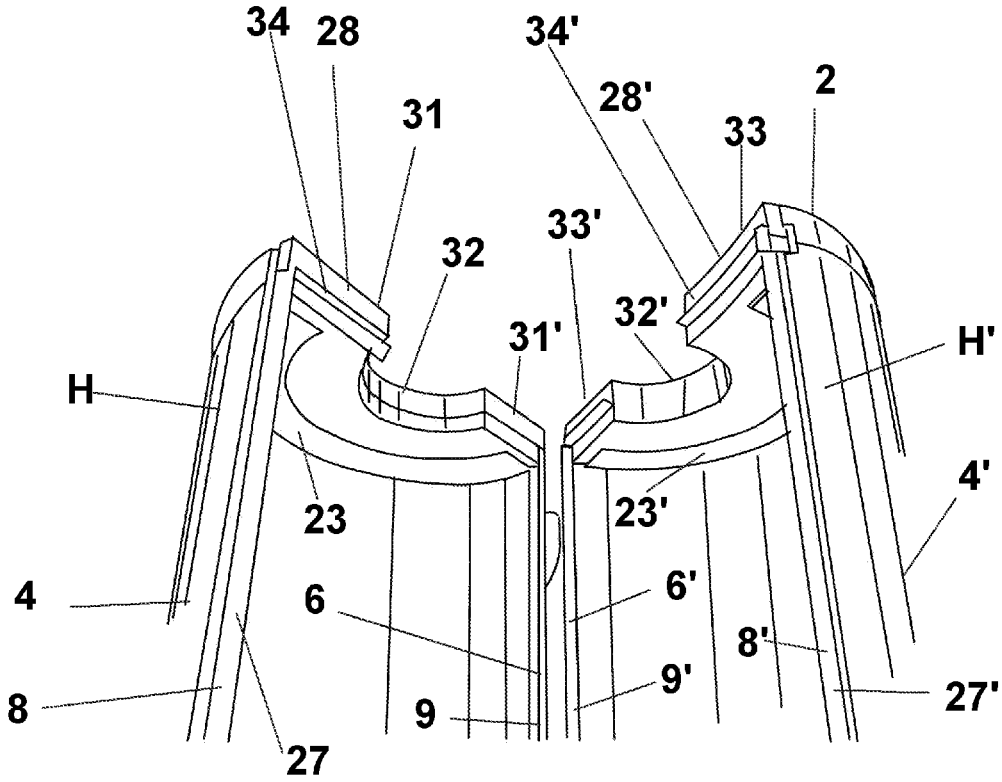
FIG. 8 is a view of the upper portion of the open collection tank formed by the two tank halves urged into an open position via the extension of the pneumatic actuators with upper seal having a radius formed to engage the OD of the drill pipe passing therethrough, further illustrating the edge seals on the tanks to provide a fluid impermeable seal when the tanks are in a closed position, enveloping the drill tubing.
Figure 8A:
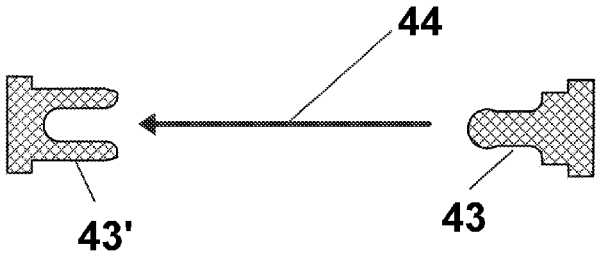
FIG. 8A is a cross-sectional, profile view of the leading edge of a seal configuration, illustrating a female profile, for use along an edge of one of the two tank halves of FIG. 8 as well as a cross-sectional, profile view of the leading edge of a male profile of an edge seal for use in the other of the two tank halves, situated so that, upon closing of the two tank halves, the male profile seal engages the female profile seal to provide fluid impermeable engagement of the two tank halves.
Figure 9A:
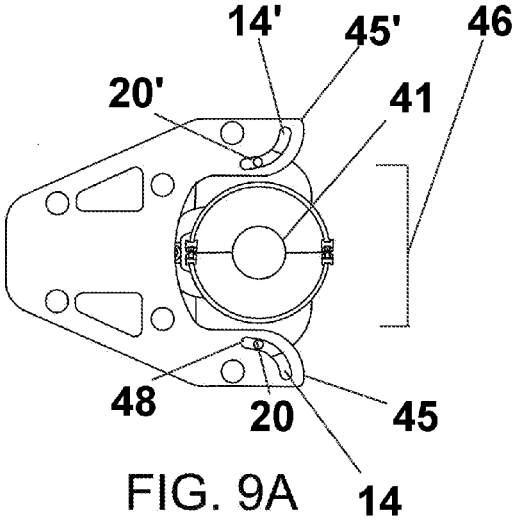
FIG. 9A is an end view of the apparatus of the present invention shown with the tanks in a closed, retracted position.
Figure 9C:
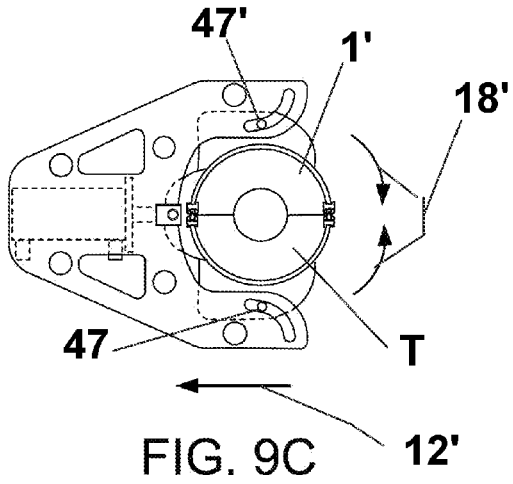
FIG. 9C is an end, partially cut-away view of the apparatus of FIG. 9A illustrating the actuator in a retracted position commensurate with the closed tank configuration.
Figure 9B:
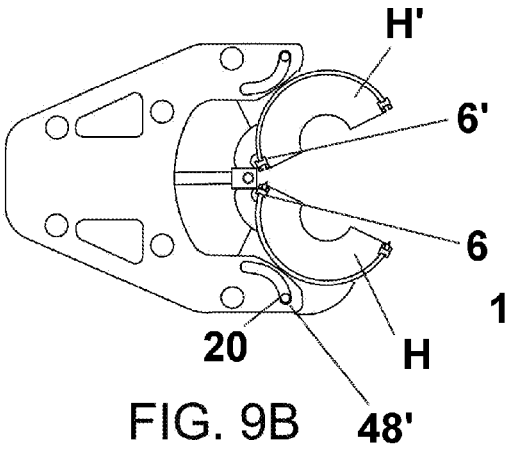
FIG. 9B is an end view of the apparatus of the present invention shown with the tanks in an open, extended position.
Figure 9D:
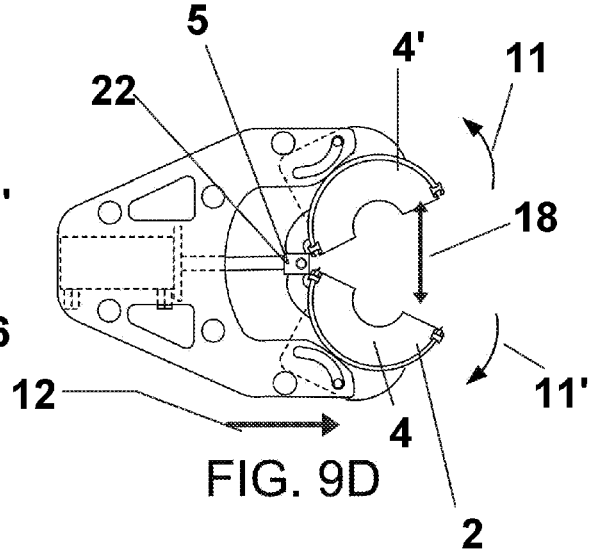
FIG. 9D is an end, partially cut-away view of the apparatus of FIG. 9D illustrating the actuator in an extended position commensurate with the open tank configuration.
Figure 10B:
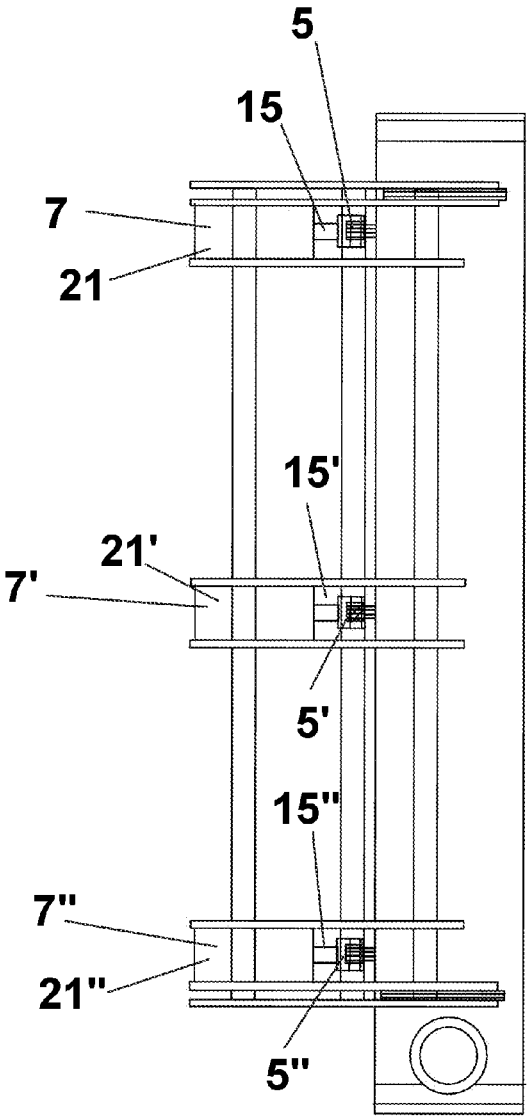
FIG. 10B is a side view of the apparatus of FIG. 10A, showing the frame with actuators in retracted position, with the tank in a closed position, and the tank drain at the side portion of the tank.
Figure 10A:
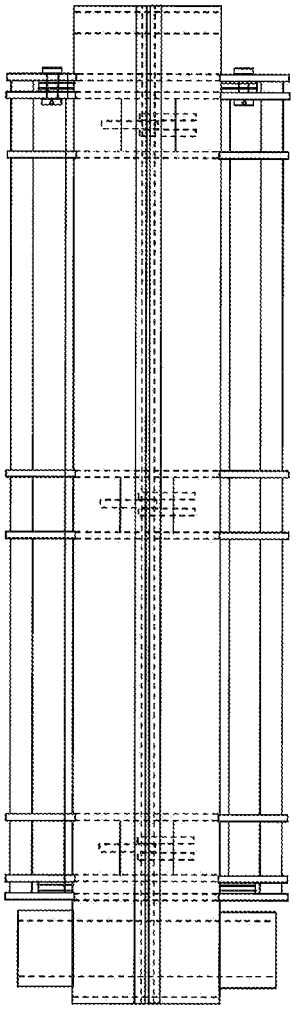
FIG. 10A is a front view of the apparatus of the present invention, illustrating the tank in a closed position.

Cylinders 21, 21', 21" of the pneumatic cylinder actuators 7, 7', 7" are provided to position respective cylinder rods 15, 15', 15" emanating therefrom so as to simultaneously extend 12 on demand via manual control button 16' which controls a pneumatic valve controller to actuate actuators 7, 7', 7". The extended 12 cylinder rods 15, 15', 15" engage connections 5, 5', 5" (shown as clevis assemblies 22 (FIG. 7)) respectively, to reposition the first 4 and second 4' split tank halves H, H', selectively pivoting 18 the first 4 and second 4' tank halves H, H' to open the tank. Control button 16 is provided to control a pneumatic valve controller to selectively urge the pneumatic cylinder actuators 7, 7', 7" to retract 12' the cylinder rods 15, 15', 15" into a second, retracted position, pivoting the first 4 and second 4' split tank halves H, H' in a second direction so as to close 18' the tank and engage the edge and end seals, to make the closed tank suitable for containing fluid (as discussed above).

Continuing with FIGS. 1, 4, 5, 9A-D, 16 and 17, the support frame 10 further engages at its first 13 and second 13' ends the first 4 and second 4' halves H, H' forming the tank T in pivotal and slotted fashion via support frames 19, 19', each support frame having opposing frame extensions 45, 45' with a space 46 therebetween for receiving the tank T, said frame extensions 45, 45' having radial slots 14, 14' formed therein for receiving pins 20, 20' from the respective first 4 and second 4' tank halves H, H', said pins having heads 47, 47' extending through the slots to allow the pin to slide along the slot same during operation, while allowing the tank component parts to pivot to support the tank components (the first 4 and second 4' tank halves H, H') and guide same from one end 48 of the slot to the other 48' when pivoting to or from open 18 position (wherein even the inner edges 6, 6' and respective seals are separated to provide a wider opening for ingress/egress of the pipe) or closed 18' position when the piston cylinder rods 15, 15', 15" from the pneumatic piston actuators extend 12 or retract 12', respectively, opening and closing the tank T, respectively.

Hinge members 49, 49' extend from the outer surface of first 4 and second 4' tank halves H, H', respectively, said hinge members pivotally engaging the cylinder rod (e.g., via clevis assembly 22) so as to allow said tank halves H, H' to fully separate guided via said radial slots 14, 14' when in the fully open position so as to be spaced to as to receive pipes P, P' and respective threaded couplings associated with said pipes connection, as well as their disconnection within tank T during use.

Continuing with FIGS. 1, 6, 7, and 16-18, to secure the first 4 and second 4' tank halves H, H' into a sealed tank configuration when brought together, a series of pinch rollers on pinch roller frames are provided along the length of the support frame 10 including medial pinch roller frames 50, 50', upper pinch roller frame 51 and lower pinch roller frame 52, and are provided above and/or below each of the pneumatic cylinder actuators 7, 7', 7". Each of the pinch roller frames 63 include a base B having emanating therefrom first 53 and second 53' support extensions having a receiving area or space 54 therebetween formed to receive the tank T or enclosure in a closed position, the support extensions 53, 53' supporting pinch rollers 55, 55' having a bearing surface within space 54.

The bearing surface 57, 57' of pinch rollers 55, 55' are formed to engage the opposing outer surface 56, 56' of the first 4 and second 4' tank halves H, H' (the "tank components"), and are positioned so as to engage the outer walls of said tank components as the piston rod of the adjacent pneumatic cylinder actuator retracts to urge the tank components into the space 54 between the pinch rollers, the rollers spaced apart about the same distance as the outer diameter of the tank T so that when the piston rod is fully retracted 55", rollers have urged the opposing outer walls of the tank components together to form a tank T that is in a fully enclosed position with the end and edge seals locked together in fluid tight engagement.

Figure 18:
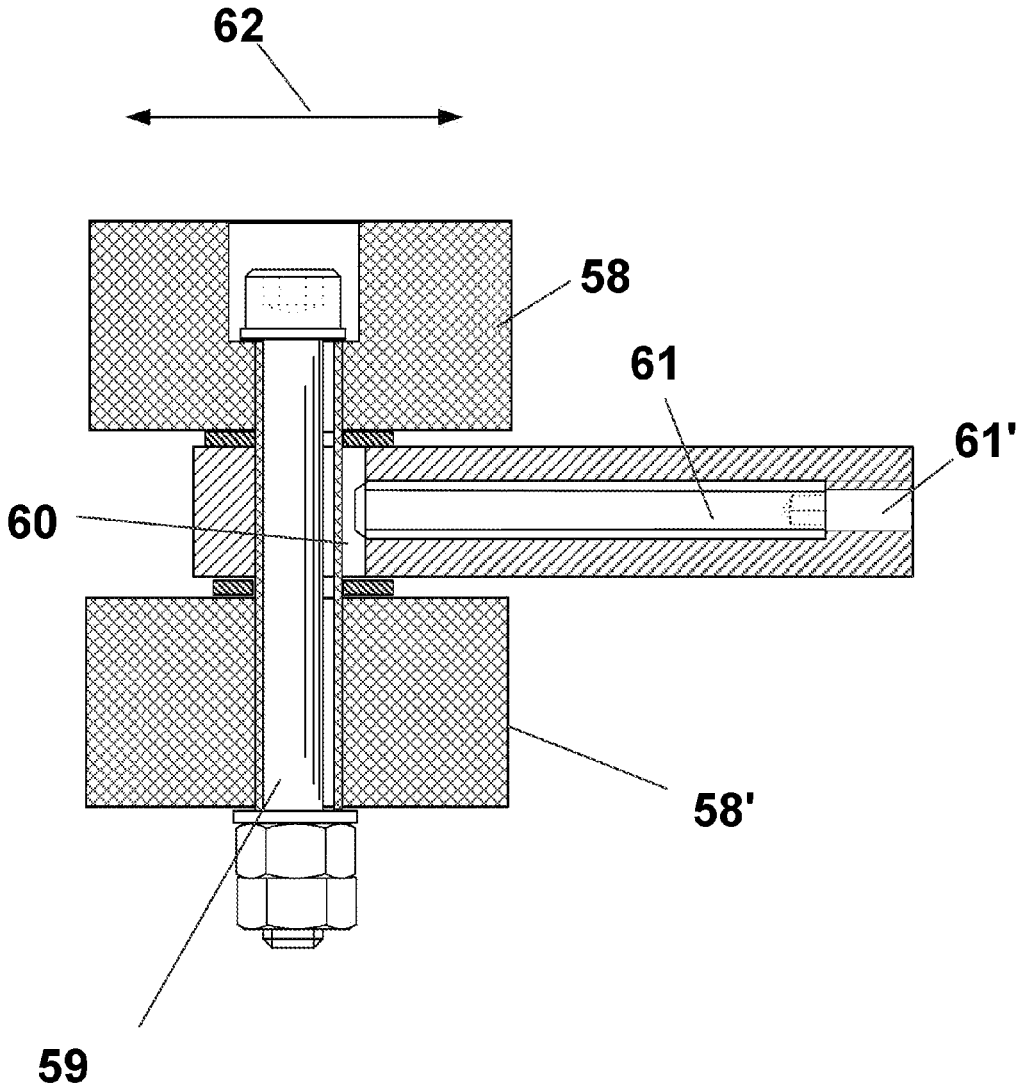
FIG. 18 is a partially cut-away, cross-sectional view of a pinch rollers of FIG. 16 mounted to the yoke support frame, further illustrating the position adjustment slot and adjustment screw.

As shown in FIG. 18, each pinch roller includes upper 58 and lower 58' rollers with a shaft 59 therebetween, the shaft 59 slidingly situated in a adjustment slot 60 to allow the rollers 55, 55' to be positioned relative to one another to properly position the tank components to provide a closed tank. An adjust threaded screw 61 is provided in threaded bore 61' to adjust the position 62 of the shaft within the slot, to fix the position of the rollers when engaging the tank components.

Figure 11A:
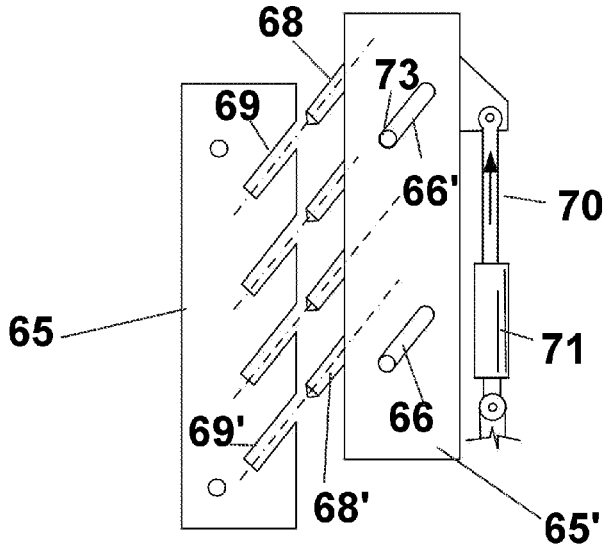
FIG. 11A is a frontal view of a latching mechanism used for securing the tank of the invention of FIG. 1 in a securely closed fashion, the mechanism shown in an unlocked position.
Figure 11B:
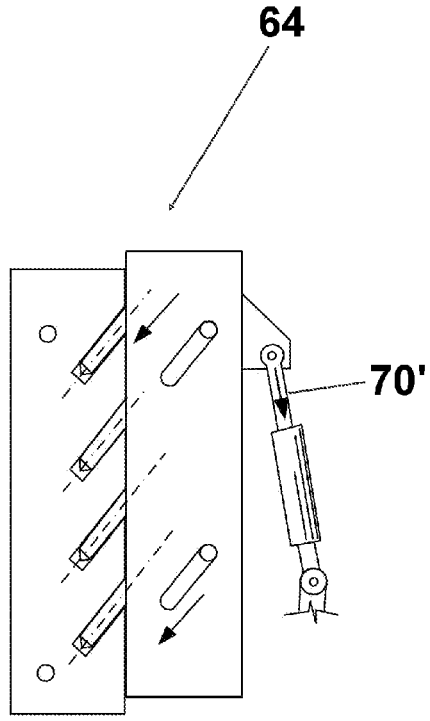
FIG. 11B is a frontal view of the latching mechanism of FIG. 11A, the mechanism shown in a locked position.

FIGS. 1, 11A and 11B illustrate a locking mechanism 64 for locking the first 4 and second 4' tank halves when brought together to form the tank. The locking mechanism 64 comprises a receiver component 65 and an extension component 65', which are mounted in aligned fashion preferably medially (about at medial position 72 of the unit) along the opposing edges of the first 4 and second 4' tank halves H, H' respectively. As shown, pneumatic linear actuator 71 is provided to reposition the extension component 65' while first 66 and second 66' guide slots are provided to each interface with a pin 73. Upon retracting the actuator, the extensions 68, 68' of extension component 65' are guided into slots 69, 69' formed in receiver component 65 so as to lock the tank halves H, H' together. Extending 70 the linear actuator 71 urges the extensions 68, 68' out of slots 69, 69' to unlock the tank halves H, H' from one another.

ELEMENTS OF THE INVENTION

T Tank
P, P' Pipe
J, J' Pipe Joints
U Unscrewed
F Fluid
O Opening
D Flows
V Vent
E Ingress of air
S Split
M Medial
H tank halves
1,'." length, first, second openings

2, 2' first, second ends
3,' drain, ID
4,' first, second tank halves
5 pivotally joined
6, 6' inner side edges of tanks where joined
7,','' actuators
8 outer edges
9,' first, second inner seal strips
10 support frame
11,' pivotally positioned
12,' extend, retract
13 first, second ends frame
14,' radial slots
15,','' cylinder rods
16,' control buttons
17 valve
18, open, close
19,' U configured support frame
20,' pins
21,','' cylinders
22 clevis assembly
23,' upper end seal mounts
24,' lower end seal mounts
25 mounting slot
26,' split seal
27,' first, second outer seal strips
28,' end seals
29,' end seals
30 seal radial outer edge
31,' seal first and second engagement faces
32,' semicircular cut
33,' seal first and second engagement faces
34,' female slot, raised ridge
35 circular pipe passage having ID
36,' seal first and second engagement faces
37,' semicircular cut
38,' seal first and second engagement faces
39 circular pipe passage having ID
40,' female slot, raised ridge
41,' inner diameter
42 pipe outer diameter
43, 43' male profile, female profile
44 seals engage
45,' first, second support members support frame
46 space between extensions for tank
47 pin heads
48,' end of slot
49
50,' Medial Pinch roller frames
51 upper pinch roller frame
52 lower pinch roller frame
53,' support members
54 space
55,' pinch rollers
56 outer surface
57,' bearing surface
58 upper, lower rollers
59 shaft
60 adjustment slot
61 adjustment threaded screw
62 adjust position of the roller
63 Pinch Roller Frame
64 locking mechanism
65,' receiver, extension components
66,' first, second guide slots
67 retract
68,' extensions
69,' slots
70 extend
71 linear actuator
72 medial unit position
73 pin The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A mud bucket for enveloping the ends of first and second pipes and collecting fluid drained therefrom, said first and second pipes having an outer diameter, said mud bucket comprising:

first and second enclosure components, each having an outer surface, a length having opposing first and second side edges and first and second ends, said first and second enclosure components joined via a pivotal connection along their length so as to be positionable from an enclosed position wherein opposing side edges of said first and second components engage to form an enclosure having a width, to an open position formed to allow the passage of said ends of said first and second pipes therethrough;

a support frame having a length supporting said first and second enclosure components;

said support frame having first and second support extensions emanating therefrom forming an enclosure receiving area therebetween to receive said width of said enclosure;

a linear actuator having first and second ends forming a length therebetween, said first end of said linear actuator engaging said support frame, said second end of said linear actuator engaging said pivotal connection joining said first and second enclosure components;

wherein, upon said linear actuator retracting, said first and second enclosure components are received by said enclosure receiving area so as to urge said enclosure components to pivot from an open position, with said second end of said linear actuator having extended to occupy said enclosure receiving area, to a closed position, wherein said side edges of said first and second components engage one another to form an enclosure occupying said enclosure receiving area, with said second end of said linear actuator having retracted from said enclosure receiving area.

2. The apparatus of claim 1, wherein said side edges of said first and second enclosure components have seals mounted along said length.

3. The apparatus of claim 2, wherein said linear actuator comprises a cylinder having a piston rod having a length formed to selectively emanate therefrom, said cylinder mounted to said support frame, said piston rod having an end engaging said pivotal connection joining said first and second enclosure components, wherein, upon extension of said linear actuator, said piston rod is positioned to substantially bisect said enclosure area.

4. The apparatus of claim 3, wherein said linear actuator comprises a pneumatic piston.

5. The apparatus of claim 3, wherein said piston rod has an end having a clevis assembly, said clevis assembly comprising a component of said pivotal connection engaging said first and second enclosure components.

6. The apparatus of claim 1, wherein, upon said linear actuator extending, said first and second enclosure components are directed from said closed position situated in said enclosure receiving area formed between said first and second support extensions, to an open position, wherein said first and second enclosure components pivot to separate from one another, with said second end of said linear actuator situated in said enclosure receiving area.

7. The apparatus of claim 6, wherein upon said linear actuator retracting to pivot first and second enclosure components to a closed position, said second end of said linear actuator is retracted from said open space formed between said support extensions.

8. The apparatus of claim 6, wherein said length of said extended linear actuated is situated parallel to said first and second extension arms of said base portion of said support frame.

9. The apparatus of claim 1, wherein said first and second ends of said enclosure each have an end seal situated therein, said end seal having formed therethrough a passage having an inner diameter formed to engage the outer diameter of said first and second pipes, so as to provide a selectively sealable enclosure therein.

10. The apparatus of claim 9, wherein said end seals are split into first and second seal components, said first seal component mounted to said first enclosure component, said second seal component mounted to said second enclosure component, whereby the engagement of said first and second enclosure components to form an enclosure engages said first and second seal components to form said end seal.

11. The apparatus of claim 10, wherein said end seal situated at said first and second ends of said enclosure is formed to be interchangeable with a collection of various size seals so as to adjust the inner diameter of said passage formed therethrough to accommodate varying outer diameters of pipe.

12. The apparatus of claim 1, wherein there is further provided a pneumatic locking assembly mounted to said first and second enclosure components so as to selectively lock said first and second enclosure components together to form said enclosure.

13. The apparatus of claim 1, wherein there is further provided first and second guide slots associated with said support frame formed to position said first and second enclosure components, respectively, upon said linear actuator extending, so as to guide said first and second enclosure components from said enclosed position to said open position, separating said edges of said first and second enclosure components from one another.

14. The apparatus of claim 13, wherein said guide slots associated with said support frame are curved.

15. The apparatus of claim 1, wherein said first and second support extensions comprise bearing surfaces formed to engage said opposing outer surfaces of said first and second enclosure components, respectively, as said linear actuator is retracted, forming said enclosure.

16. The apparatus of claim 15, wherein said bearing surfaces comprise pinch rollers.

17. The apparatus of claim 16, wherein said support frame comprises a base portion, with said first and second support extension emanating from said base portion, and wherein said linear actuator engages said base portion.

18. The apparatus of claim 17, wherein said enclosure receiving area is situated substantially along the length of said support frame.

19. The apparatus of claim 18, wherein said enclosure receiving area formed between said first and second support extensions is situated substantially along the length of said support frame and wherein, upon said linear actuator retracting, said first and second enclosure compartments are received by said enclosure receiving area so as to allow said first and second pinch rollers to engage said opposing outer surfaces of said first and second enclosure components, respectively, to urge said enclosure components to pivot to a closed position, so as to form an enclosure.

20. The apparatus of claim 1, wherein said first and second support extensions have mounted thereto first and second pinch rollers, respectively, formed to receive said width of said enclosure, said first and second pinch rollers formed to engage said opposing outer surfaces of said first and second enclosure components, respectively, as said linear actuator is retracted, forming said enclosure.

21. The apparatus of claim 1, wherein said first and second enclosure components comprise tank halves, and wherein said enclosure forms fluid collection tank having a drain.

22. The apparatus of claim 1, wherein said enclosure formed by said first and second enclosure components is formed to envelope the ends of first and second drill pipes.

23. A method of capturing fluid, comprising the steps of:

a) providing first and second, generally vertically oriented pipes joined at their ends, at least one of said first or second pipes having fluid therein;

b) providing first and second enclosure components having an outer surface, said first and second enclosure components pivotally attached along their length;

c) providing a support frame having a length having situated thereon first and second base portions, each of said first and second base portions having first and second support extensions laterally emanating therefrom defining an enclosure receiving area therebetween, said enclosure receiving area situated along substantially said length of said support frame;

d) providing first and second linear actuators having first and second ends forming a length therebetween, said first end of said first and second linear actuators engaging said support frame, said second end of said first and second linear actuators perpendicularly engaging, in spaced relationship, said pivotal connection joining said first and second enclosure components;

e) extending said first and second linear actuators so that said length of said first and second linear actuators are aligned in parallel with one another, with said second end of said first and second linear actuators extending into said enclosure receiving area, while pivotally positioning said first and second enclosure components to an open position to receive said joined ends of said first and second pipes;

d) retracting said first and second linear actuators, retracting said second end of said first and second linear actuators from said enclosure receiving area, while positioning said first and second enclosure components into said enclosure receiving area while urging said first and second enclosure components to pivot to a closed position so that said first and second enclosure components form an enclosure about said joined ends of said first and second pipes;

e) unjoining said first pipe from said second pipe;

f) allowing fluid to drain from said first pipe, providing drained fluid;

g) allowing said enclosure to collect said drained fluid, providing collected fluid;

h) directing said collected fluid from said enclosure.

24. The method of claim 23, wherein in step "d", there is further provided the step providing first and second pinch rollers supported by first and second support members, respectively, said pinch rollers forming opposing bearing surfaces spaced to receive said first and second enclosure components and urge first and second enclosure components to join along their length to form an enclosure.

25. The method of claim 24, wherein in step "b" said first and second enclosure components have lengths having opposing edges relative to one another, and ends, and wherein said lengths have a seal mounted thereon such that opposing edges have interlocking seals and in step "d" said opposing edges are brought together so as to lock said interlocking seals with one another.

26. The apparatus of claim 23, wherein in step "b" one of said first or second enclosure components has a drain to selectively drain fluid therefrom, and in step "h" there is further provided the additional step "hl" of utilizing said drain in said enclosure, and "h2" of utilizing said drain to direct said collected fluid from said enclosure.

27. The method of claim 23, wherein in step "c" there is provided the added step "c1" of providing first and second pinch rollers mounted to said first and second support extensions, respectively, and wherein in step "d" said first and second pinch rollers are used to apply force to the outer surface of said first and second enclosure components, respectively.

28. A method of collecting fluid from first and second pipes joined at their ends, comprising the steps of:

a. providing a generally cylindrical enclosure split along its length into first and second components joined at one side so as to be pivotally adjustable from an open to closed position;

b. providing a support frame having a length and a linear actuator having first and second ends, said first end engaging said support frame, said second end engaging said cylindrical enclosure, said support frame having first and second bearing surfaces situated along opposing sides thereof, respectively, with an enclosure receiving area therebetween, said enclosure receiving area extending substantially along the length of said support frame;

c. extending said second end of said linear actuator into said enclosure receiving area to urge said enclosure away from said support frame so as to pivotally separate said first and second components, providing an open enclosure;

d. positioning a section of said joined first and second pipes within said open enclosure;

e. retracting said second end of said linear actuator from said enclosure receiving area to urge said pivotally separated first and second components forming said enclosure toward said enclosure receiving area formed between said first and second bearing surfaces of said support frame, while utilizing first and second bearing surfaces of said support frame to urge said first and second components to pivot so as to enclose said section of said first and second pipes;

f. un-joining said first and second pipes, allowing fluid to drain therefrom, providing drained fluid;

g. allowing said enclosure to collect said fluid;

h. directing said fluid from said enclosure.

29. The method of claim 28, wherein after step "h" there is further provided the additional step "I" of utilizing said linear actuator to urge said enclosure away from said support frame, while utilizing first and second radial slots in communication with said first and second components, respectively, to urge said first and second components apart into an open position so that said first and second pipes are removeable therefrom.

30. The method of claim 29, wherein there is further provided in step "e" the additional step "e1" of locking said first and second components with a pneumatic locking mechanism.

31. The method of claim 28, wherein in step "e" said first and second bearing surfaces of said support frame engage said outer surface of said first and second first and second components.

32. A method of collecting fluid from first and second pipes joined at their ends, comprising the steps of:

a. providing a generally cylindrical enclosure split along its length into first and second components joined at one side so as to be pivotally adjustable from an open to closed position, providing a pivotal connection;

b. providing a support frame having a linear actuator having a length and first and second ends, said first end of said linear actuator engaged to said support frame, said support frame having first and second bearing surfaces having an enclosure receiving area therebetween;

c. extending said second end of said linear actuator into said enclosure receiving area to urge said enclosure away from said enclosure receiving area and pivotally separate said first and second components, providing an open enclosure;

d. positioning said open enclosure adjacent to a section of joined first and second pipes;

e. retracting said linear actuator to position said pivotally separated first and second components forming said enclosure into said open space formed between said first and second bearing surfaces, while using said first and second bearing surfaces to urge said first and second components to pivot to facilitate the engagement of said first and second components about said section of said first and second pipes, enclosing same;

f. un-joining said first and second pipes, allowing fluid to drain therefrom, providing drained fluid;

g. allowing said enclosure to collect said fluid;

h. directing said fluid from said enclosure.

33. The method of claim 32, wherein in step "b" said first and second bearing surfaces having associated therewith first and second pinch rollers, respectively, and in step "e" said first and second spaced pinch rollers are used in conjunction with said first and second bearing surfaces of said support frame to apply pressure to said outer surface of said first and second components, respectively, to force same together to enclose same.

34. The method of claim 33, wherein after step "h" there is further provided the additional step "I" of utilizing said linear actuator to urge said enclosure away from said support frame, while utilizing first and second radial slots in communication with said first and second components, respectively, to urge said first and second components pivot at said pivotal connection into an open position so that said first and second pipes are removeable therefrom.

35. The method of claim 34, wherein there is further provided in step "e" the additional step "e1" of locking said first and second components with a locking mechanism, and an additional step "h1" after step "h" of unlocking said locking mechanism, unlocking said first and second components.

36. The method of claim 35, wherein in step "e1" there is further provided the step of "e1i" providing in said locking mechanism a receiver component and an extension component, said receiver component formed to selectively receive from said extension component an extension so as to lock said receiver component to said extension component, said extension actuated by an actuator; "e1ii" mounting said receiver component and said actuator in alignment along opposing edges of said first and second components, distal from said pivotal connection engaging said first and second components, "e1iii" initiating said actuator so as to thrust said extension at an angle to engage said receiver component, locking said first and second components together; and in step "h1" there is further provided the step "h1i" of reversing said actuator so as to withdraw said extension from said receiver component, unlocking said first and second components.

37. The method of claim 36, wherein in step "e1iii" said actuator thrusts said extension to engage said receiver component at about a 45 degree angle.

38. A method of collecting fluid from first and second pipes joined at their ends, comprising the steps of:

a. providing a generally cylindrical enclosure formed from first and second components joined along one side so as to be pivotally adjustable from an open to closed position;

b. providing a support frame having a length and first and second support extensions defining an enclosure receiving area therebetween, said enclosure receiving area extending substantially along the length of said support frame;

c. providing a linear actuator having first and second ends, said first end of said linear actuator engaging said support frame, said second end engaging said cylindrical enclosure;

d. extending said second end of said linear actuator into said enclosure receiving area, urging said enclosure away from said support frame, while pivotally separating said first and second components, providing an open enclosure;

e. positioning a section of said joined first and second pipes within said open enclosure;

f. retracting said second end of said linear actuator from said enclosure receiving area to position said first and second components within said enclosure receiving area, while pivoting first and second components about a portion of said first and second pipes, enclosing same with said enclosure;

g. un-joining said first and second pipes, allowing fluid to drain therefrom, providing drained fluid;

h. allowing said enclosure to collect said fluid;

i. draining said fluid from said enclosure.

39. The method of claim 38, wherein after step "i" there is further provided the additional step "j" of extending said second end of linear actuator to urge said enclosure away from said support frame and urge said first and second components apart into an open position so that said first and second pipes are removeable therefrom, and repeating steps f-i.

40. A method of collecting fluid from first and second pipes joined at their ends, comprising the steps of:

a. providing a generally cylindrical enclosure formed from first and second components joined at one side so as to be pivotally adjustable from an open to closed position;

b. providing a support frame having a linear actuator having a length and first and second ends, said support frame having first and second extensions defining an enclosure receiving area formed therebetween;

c. providing a linear actuator having first and second ends, said second end of said linear actuator engaging said enclosure;

d. extending said second end of said linear actuator into said enclosure receiving area to urge said enclosure away from said enclosure receiving area, and pivotally separate said first and second components, providing an open enclosure;

e. positioning said first and second pipes within said open enclosure;

f. retracting said linear actuator to position said pivotally separated first and second components to said enclosure receiving area while urging said first and second components to pivot at said pivotal connection, to facilitate the engagement of said first and second components to enclose said section of said first and second pipes;

g. un-joining said first and second pipes, allowing fluid to drain therefrom, providing drained fluid;

h. allowing said enclosure to collect said fluid;

i. directing said fluid from said enclosure.

41. The invention of claim 40, wherein after step "c" said first end of said linear actuator is associated with said support frame.

42. The method of claim 40, wherein after step "i" there is further provided the additional step "j" of extending said second end of linear actuator to urge said enclosure away from said support frame and urge said first and second components apart into an open position so that said first and second pipes are removeable therefrom, and repeating steps e-j.

* * * * *

UNITED STATES PATENT AND TRADEMARK OFFICE

CERTIFICATE OF CORRECTION

PATENT NO. : 8,839,853 B1
APPLICATION NO. : 12/910710
DATED : September 23, 2014
INVENTOR(S) : John W Angers, Jr.

It is certified that error appears in the above-identified patent and that said Letters Patent is hereby corrected as shown below:

In the Claims

Claim 23, Column 10, line 48: replace “d)” with -- f) --.

Claim 23, Column 10, line 57: replace “e)” with -- g) --.

Claim 23, Column 10, line 58: replace “f)” with -- h) --.

Claim 23, Column 10, line 60: replace “g)” with -- i) --.

Claim 23, Column 10, line 62: replace “h)” with -- j) --.

Claim 32, Column 12, line 29: replace “open space” with -- enclosure receiving area --.

Signed and Sealed this
Seventeenth Day of March, 2015

Michelle K. Lee

Michelle K. Lee
*Director of the United States Patent and Trademark Office*